US009745916B2

(12) United States Patent
Yokotani et al.

(10) Patent No.: US 9,745,916 B2
(45) Date of Patent: Aug. 29, 2017

(54) INTERNAL COMBUSTION ENGINE

(75) Inventors: Hitoshi Yokotani, Wako (JP); Takaaki Shomura, Wako (JP); Hiroshi Sotani, Wako (JP); Teppei Maeda, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 756 days.

(21) Appl. No.: 13/608,173

(22) Filed: Sep. 10, 2012

(65) Prior Publication Data

US 2013/0081595 A1 Apr. 4, 2013

(30) Foreign Application Priority Data

Sep. 29, 2011 (JP) ..... 2011-214359

(51) Int. Cl.

| | |
|---|---|
| ***F02F 1/24*** | (2006.01) |
| ***F02M 69/04*** | (2006.01) |
| *F02D 9/10* | (2006.01) |
| *F02D 9/02* | (2006.01) |

(52) U.S. Cl.

CPC ..... *F02F 1/242* (2013.01); *F02M 69/044* (2013.01); *F02D 9/105* (2013.01); *F02D 9/107* (2013.01); *F02D 2009/0206* (2013.01)

(58) Field of Classification Search

CPC ..... F02M 35/10072; F02M 35/10078; F02M 35/10085; F02M 35/10091; F02M 35/10111; F02M 35/10216; F02M 35/10288; F02M 35/108; F02M 35/1085; F02M 2700/126; F02M 69/044

See application file for complete search history.

(56) References Cited

U.S. PATENT DOCUMENTS

| | | | | |
|---|---|---|---|---|
| 5,186,140 | A * | 2/1993 | Ueda et al. | 123/308 |
| 5,203,299 | A * | 4/1993 | Ueka | 123/308 |
| 5,269,270 | A * | 12/1993 | Suzuki | F01L 1/267 123/193.5 |
| 5,671,712 | A * | 9/1997 | Uchida | 123/308 |
| 5,957,112 | A * | 9/1999 | Takahashi et al. | 123/469 |
| 6,499,456 | B1 * | 12/2002 | Nogi | F02B 1/12 123/295 |
| 2002/0052158 | A1 * | 5/2002 | Nakamura | F01N 13/004 440/89 F |
| 2004/0035392 | A1 * | 2/2004 | Ohsuga | F02B 27/02 123/399 |

(Continued)

FOREIGN PATENT DOCUMENTS

| | | | |
|---|---|---|---|
| JP | 10325359 | A * | 12/1998 |
| JP | 2004-138020 | A | 5/2004 |

(Continued)

*Primary Examiner* — Erick Solis
*Assistant Examiner* — Anthony L Bacon
(74) *Attorney, Agent, or Firm* — Squire Patton Boggs (US) LLP

(57) ABSTRACT

An intake port is configured such that a center position of an intake upstream side opening is offset to one side in a juxtaposition direction of intake downstream side openings with respect to a center position between the intake downstream side openings in the juxtaposition direction as viewed in plan of a cylinder head. An injector is configured such that a fuel injection center axial line is inclined to the other side in the juxtaposition direction with respect to a center axial line of the intake upstream side opening as viewed in plan of the cylinder head.

10 Claims, 11 Drawing Sheets

(56) References Cited

U.S. PATENT DOCUMENTS

| | | | | |
|---|---|---|---|---|
| 2005/0241612 | A1* | 11/2005 | Ward | F02B 23/08 123/301 |
| 2007/0056536 | A1* | 3/2007 | Lanteires | 123/90.15 |
| 2007/0215102 | A1* | 9/2007 | Russell | F02D 41/0025 123/310 |
| 2008/0184961 | A1* | 8/2008 | Miyashiro | F01N 13/20 123/445 |
| 2008/0289604 | A1* | 11/2008 | Joseph | F02D 35/023 123/406.51 |
| 2010/0326379 | A1* | 12/2010 | Beall | F02B 75/24 123/41.74 |
| 2012/0132174 | A1* | 5/2012 | Boyer | F02D 41/401 123/305 |

FOREIGN PATENT DOCUMENTS

| | | | |
|---|---|---|---|
| JP | 2006-283726 | A | 10/2006 |
| JP | 2008-075607 | A | 4/2008 |

* cited by examiner (a)

(b)

(a)

(b)

INTERNAL COMBUSTION ENGINE

BACKGROUND

Field

This invention relates to an intake structure for an internal combustion engine.

Description of the Related Art

Conventionally, an intake structure for an internal combustion engine is sometimes provided with a single fuel injection valve for forming spray foams equally to the left and right toward two branch passages of an intake port, as shown, for example, in Japanese Patent No. 4129729 (Patent Document 1).

In the prior art described above, if the fuel injection valve is displaced from the center position between the branch passages of the intake port, then consideration regarding adhesion of fuel to the port inner wall, suppression of increase of hydrocarbon (HC) in exhaust gas arising from such adhesion of fuel, and so forth, become issues.

In particular, adhesion of fuel to the port inner wall in a port injection gasoline engine increases HC in exhaust gas to increase the purification load on the exhaust system or sometimes has an influence on feedback control of fuel injection because liquid-phase fuel is liable to flow into the cylinder.

SUMMARY

Therefore, it is an object of the present invention to efficiently dispose, in an internal combustion engine which includes an intake port which forms two branch passages, a single fuel injection valve for injecting fuel into the branch passages.

In certain embodiments, the invention provides an internal combustion engine including two intake valves provided per one cylinder, and an intake port formed in a cylinder head. The intake port can be branched to two for communicating two intake downstream side openings, which are individually opened and closed by the intake valves, and a single intake upstream side opening to which an intake system part is connected. A fuel injection valve can be attached to the intake system part for injecting fuel into the intake port. The intake downstream side openings are juxtaposed at an equal height from a mating face of the cylinder head with a cylinder main body. The intake port is configured such that a center position of the intake upstream side opening is offset to one side in a juxtaposition direction of the intake downstream side openings with respect to a center position between the intake downstream side openings in the juxtaposition direction as viewed in plan of the cylinder head. The fuel injection valve disposed at an upper portion of the intake system part is configured such that a fuel injection center axial line thereof is inclined to the other side in the juxtaposition direction with respect to a center axial line of the intake upstream side opening as viewed in plan of the cylinder head.

According to other embodiments of the invention, a center axial line of the cylinder head passing the cylinder center is inclined with respect to a vertical direction such that the other side thereof in the juxtaposition direction is positioned higher, and the fuel injection valve is disposed at a top portion of the intake system part in the vertical direction.

According to another embodiment of the invention, the intake system part has a throttle body disposed on the upstream side of the intake port and an insulator for interconnecting the throttle body and the intake port. At a top portion of the throttle body in the vertical direction, the fuel injection valve is disposed and a fuel spray relief portion is formed by cutting away an inner wall thereof. At a top portion of the insulator in the vertical direction, a second fuel spray relief portion connecting to the fuel spray relief portion of the throttle body is formed by cutting away an inner wall thereof.

According to another embodiment of the invention, the throttle body has a tubular main body which forms an intake passage, a pivot shaft which crosses the intake passage horizontally, and a throttle valve supported on the main body through the pivot shaft for opening and closing the intake passage. The fuel injection valve carries out fuel injection which is branched to two directions along a plane parallel to a center axial line of the pivot shaft.

In another embodiment, the invention provides the internal combustion engine further including a throttle drum secured to one end of the pivot shaft, a sensor for engaging with the other end of the pivot shaft, an L-shaped hose joint connected to the fuel injection valve, and a fuel hose extending above the sensor and connected to the hose joint.

In certain embodiments, fuel can be injected from the fuel injection valve, which is offset to the one side in the juxtaposition direction of the intake downstream side openings together with the intake upstream side opening, toward the two branch passages of the intake port while suppressing one-sidedness. Consequently, adhesion fuel to the port inner wall can be reduced thereby to achieve purification of exhaust gas components and enhancement in an engine performance.

In some embodiments, the mounting angle of the fuel injection valve on the intake passage is easy to stand in a direction perpendicular to the intake passage, and the relief shape of fuel injection to be formed on the intake system part can be reduced in size. Further, adhesion fuel to the port inner wall can be further reduced while making a port particle characteristic smooth, and purification of exhaust gas components and enhancement in engine performance can be anticipated.

In some embodiments, the mounting position of the fuel injection valve can be positioned near to the intake port, and fuel can be injected efficiently to the downstream side of the intake port. Further, adhesion fuel to the port inner wall can be further reduced to achieve purification of exhaust gas components and enhancement in engine performance.

In certain embodiments, even where the intake port is inclined on the left or right, intake air and fuel spray in a transition state upon an increase of the opening of the throttle valve from a low opening state cross with each other in the same phase in a circumferential direction. Consequently, one-sidedness in production of fuel air mixture can be reduced, and adhesion fuel to the port inner wall can be reduced to achieve purification of exhaust gas components and enhancement in engine performance.

In some embodiments, cord-like members such as a throttle cable and a fuel hose connected to the throttle drum and wiring lines connected to the sensor can be arranged optimally around the throttle body.

DETAILED DESCRIPTION

Embodiments of the present invention is described with reference to the drawings. It is to be noted that, unless otherwise specified, such directions as forward, rearward, leftward and rightward directions are the same as those on a vehicle to be described below. Further, at suitable positions in the figures used in the following description, an arrow mark FR indicative of the vehicle forward direction, another arrow mark LH indicative of the vehicle leftward direction, and a further arrow mark UP indicative of the vehicle upward direction are shown.

Figure 1:
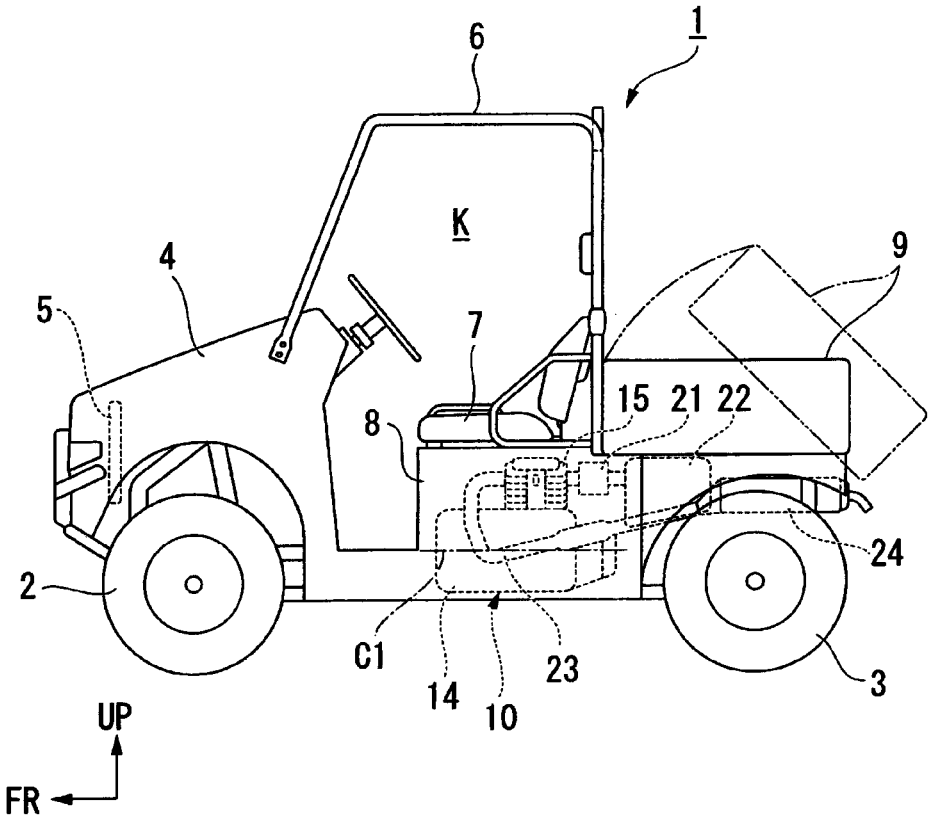
FIG. 1 is a left side elevational view of a vehicle according to an embodiment of the present invention.

A vehicle shown in FIG. 1 is a vehicle such as a multi-utility vehicle (MUV) 1 of a comparative small size designed principally for running on a rough terrain and is configured as a four-wheeled car having a pair of left and right front wheels 2 and a pair of left and right rear wheels 3 on the front side and the rear side thereof, respectively.

The vehicle 1 has, at a front portion of a vehicle body thereof at which the left and right front wheels 2 are provided, a bonnet or hood 4 mounted for upwardly and downwardly opening and closing movement through a hinge or the like, and a radiator 5 disposed on the inner side of a front portion of the bonnet 4. The vehicle 1 can also have at a mid portion of the vehicle body thereof in which an occupant space K is formed, a roll bar 6 surrounding the periphery of the occupant space K, a seat 7 for being seated by an occupant, an engine 10 disposed below the seat 7, and a vehicle body cover 8 for covering the periphery of the engine 10 and supporting the seat 7. A movable carrier 9 is provided at a rear portion of the vehicle body at which the left and right rear wheels 3 are provided.

Figure 2:
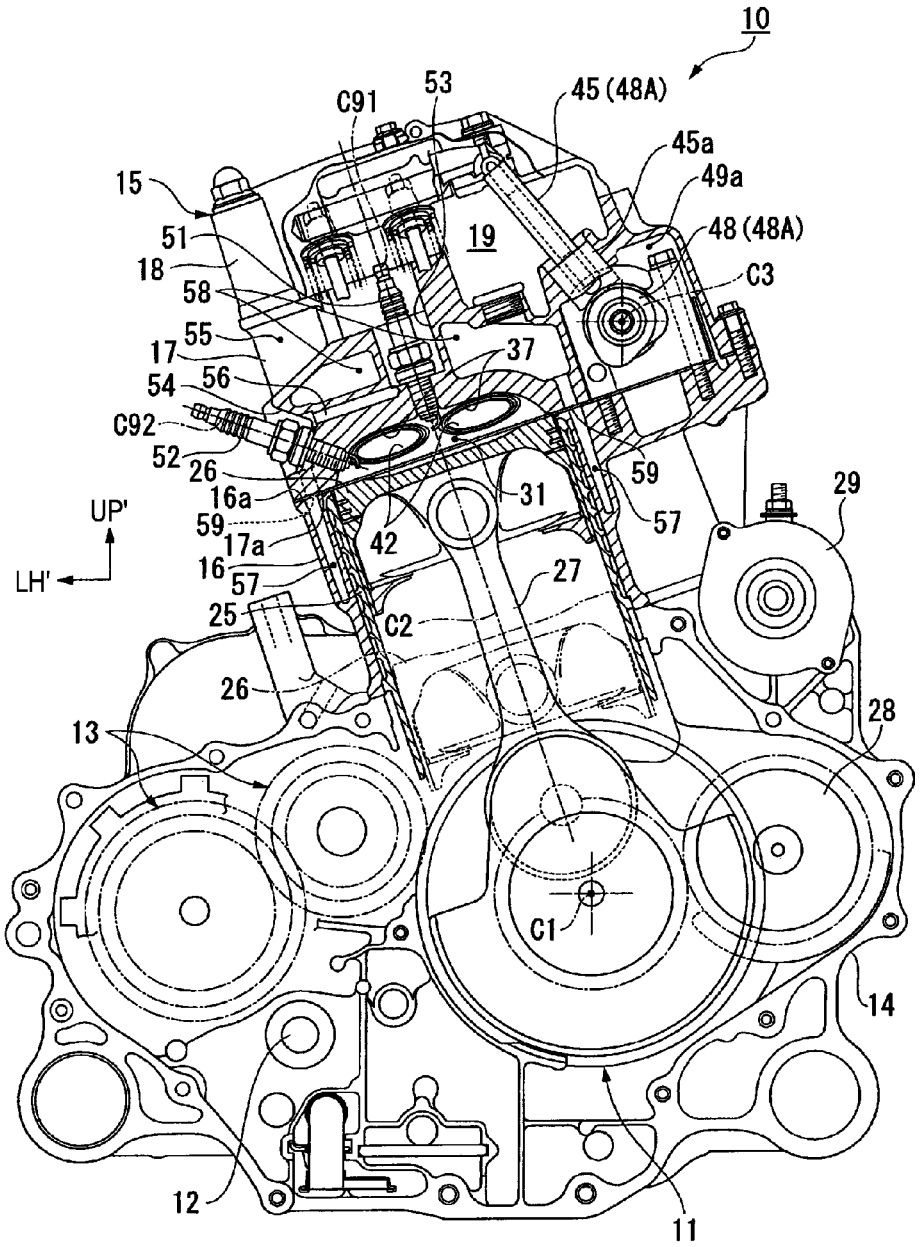
FIG. 2 is a rear elevational view of the vehicle.

Referring also to FIG. 2, the engine 10 is a prime mover of the vehicle 1 and is placed in a so-called vertical placement in which rotational center axial line (crank axial line) C1 of a crankshaft 11 extends in the forward and backward direction of the vehicle. Driving force of the engine 10 is transmitted to the left and right front wheels 2 and the left and right rear wheels 3 through a propeller shaft, a differential mechanism and so forth not shown. On the left side of a lower portion of the engine 10, an output power shaft 12 to which the propeller shaft is connected projects forwardly and rearwardly.

The engine 10 has a crankcase 14 in which the crankshaft 11 and a transmission 13 are accommodated, and a cylinder 15 erected uprightly on the crankcase 14.

The cylinder 15 stands uprightly in an inclined relationship such that the upper side thereof is positioned on the left side. In particular, the cylinder 15 standing uprightly on the crankcase 14 in the engine disposed below the seat 7 is inclined so that the height of the seat 7 is suppressed to achieve lower arrangement of the center of gravity and enhancement in facility in getting on and off. It is to be noted that reference symbol C2 indicates an axial line (cylinder axial line) extending along the uprightly standing direction of the cylinder 15.

The cylinder 15 has a cylinder main body 16 attached to the crankcase 14, a cylinder head 17 attached to an upper end portion of the cylinder main body 16, and a head cover 18 attached to an upper end portion of the cylinder head 17. The cylinder axial line C2 is a center axial line of a cylinder bore of the cylinder main body 16 and the cylinder head 17. The head cover 18 closes up an upper space of the cylinder head 17 to define a valve chamber 19. In the following description, an upward and downward direction along the cylinder axial line C2 of the cylinder 15 is referred to as cylinder upward and downward direction and a leftward and rightward direction perpendicular to the cylinder axial line C2 is referred to as cylinder leftward and rightward direction. Further, an upward direction of the cylinder upward and downward direction in the figure is indicated by an arrow mark UP' and a leftward direction of the cylinder leftward and rightward direction is indicated by an arrow mark LH'.

Figure 3:
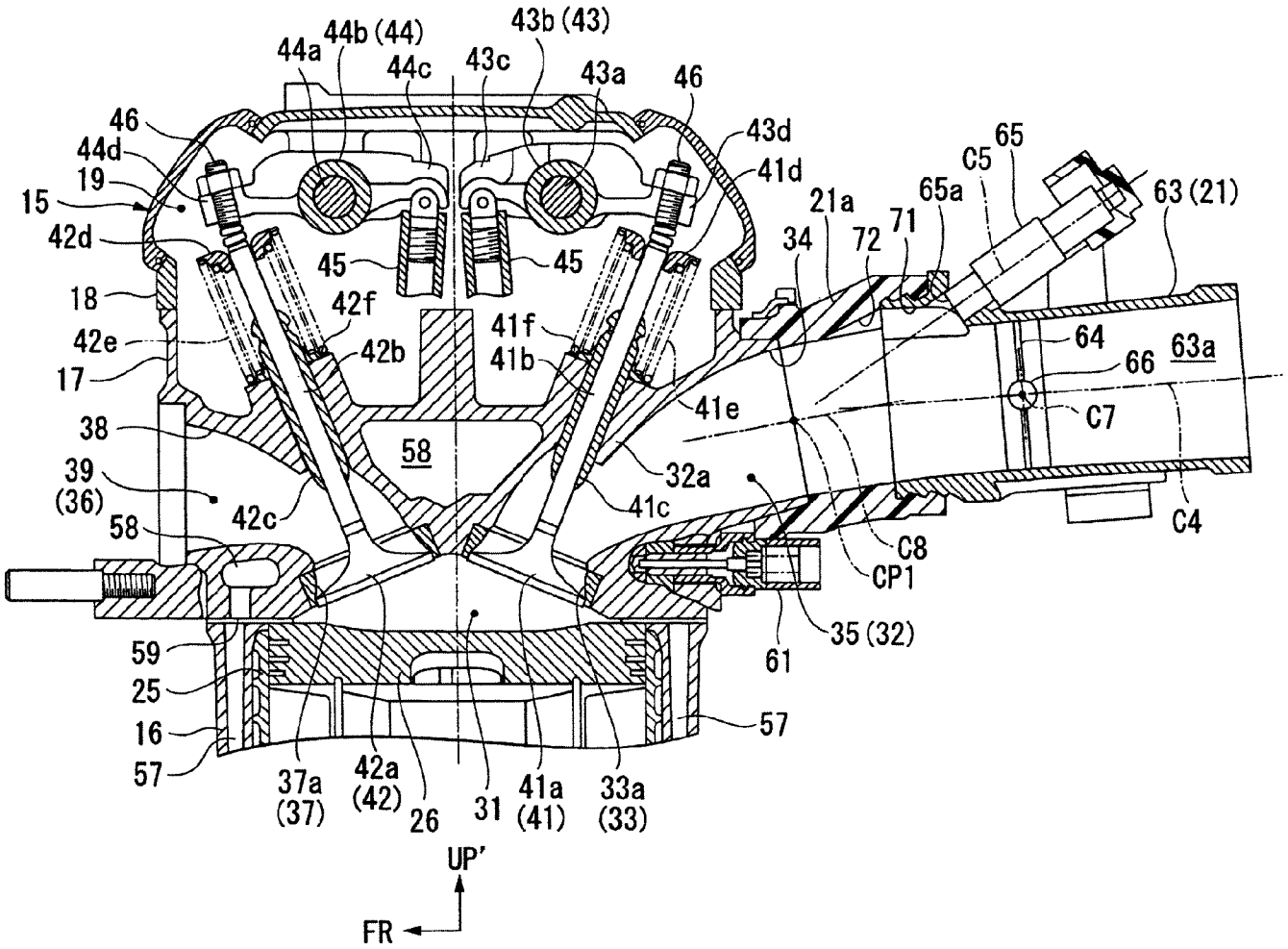
FIG. 3 is a sectional view taken along a cylinder axial line around a cylinder head of the engine.

Referring also to FIG. 3, intake system parts 21A such as a throttle body 21 and an air cleaner 22 are connected to a rear portion of the cylinder head 17. An exhaust pipe 23 is connected at a base end portion thereof to a front portion of the cylinder head 17. Leftwardly of the engine 10, the exhaust pipe 23 is folded back and extends rearwardly until it is connected to a silencer 24 disposed at a rear portion of the vehicle body.

A sleeve 25 which forms a cylinder bore is cast in the cylinder main body 16, and a piston 26 is fitted for back and forth movement in the sleeve 25. The piston 26 is connected to the crankshaft 11 through a connecting rod 27 so that back and forth movement of the piston 26 is converted into rotational movement of the crankshaft 11. It is to be noted that reference numeral 28 denotes a balancer, and reference numeral 29 denotes a starter motor.

The cylinder head 17 cooperates with the piston 26 to form a combustion chamber 31 of the pent-roof type. In a region of the cylinder head 17 opposing to an upper face of the piston 26, front and rear inclined faces which exhibit a shallow inverted V shape as viewed in the cylinder leftward and rightward direction so as to form a ceiling of the combustion chamber 31 is formed. The engine 10 can be a water-cooled four-valve OHV single cylinder engine, and a pair of left and right intake downstream side openings 33 are formed on the rear inclined face described above such that they are juxtaposed along the cylinder leftward and rightward direction at an intake port 32. Meanwhile, on the front inclined face described above, a pair of leftward and rightward exhaust upstream side openings 37 are formed such that they are juxtaposed along the cylinder leftward and rightward direction of an exhaust port 36. The left and right intake downstream side openings 33 are opened and closed by left and right intake valves 41, and the left and right exhaust upstream side openings 37 are opened and closed by left and right exhaust valves 42.

Figure 4:
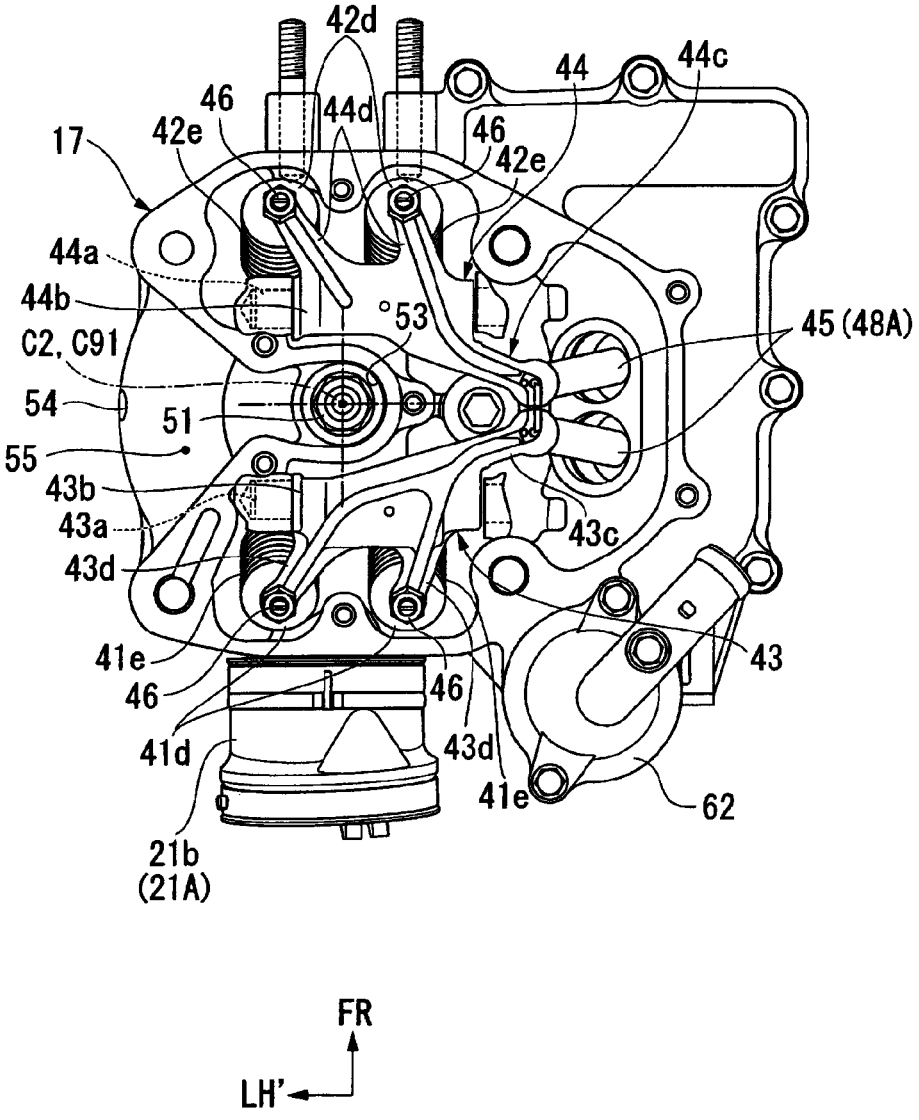
FIG. 4 is a top plan view taken along the cylinder axial line of the cylinder head.
Figure 5:
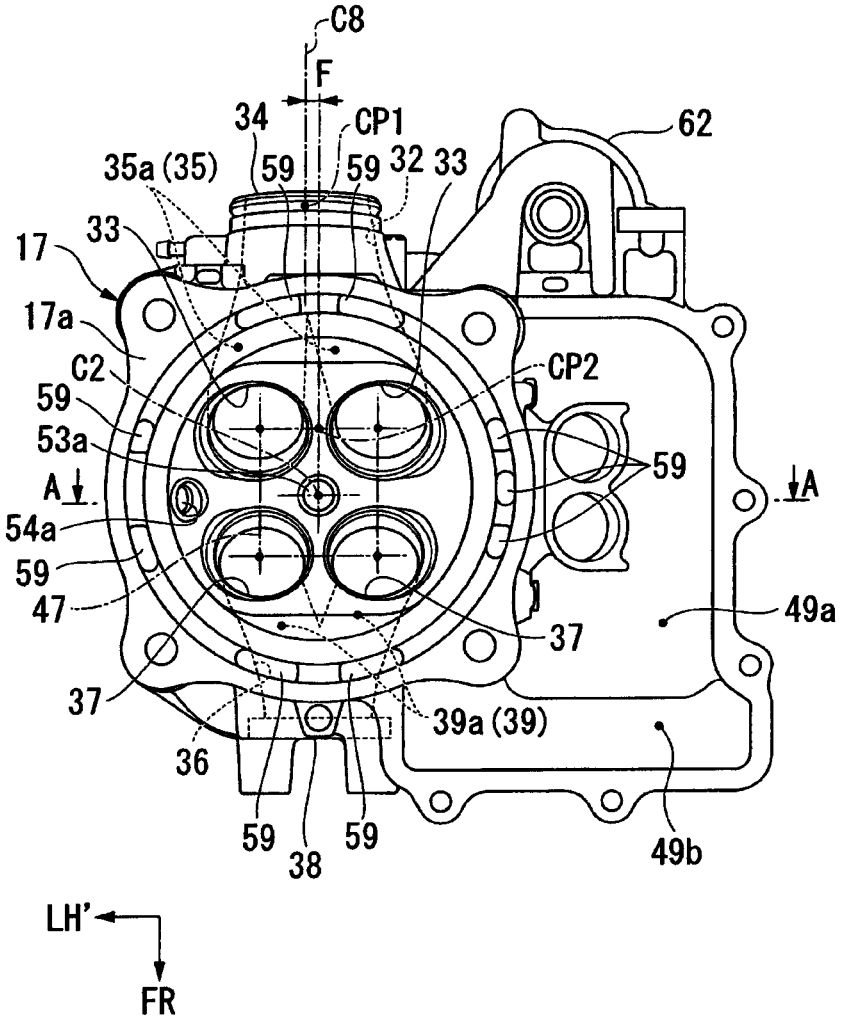
FIG. 5 is a bottom plan view taken along the cylinder axial line of the cylinder head.

Referring to FIGS. 3 to 5, the intake port 32 has the left and right intake downstream side openings 33 open inwardly of the combustion chamber 31, a single intake upstream side opening 34 open rearwardly on a rear face of the cylinder head 17, and a head internal intake passage 35 for communicating the left and right intake downstream side openings 33 and the intake upstream side opening 34 with each other. The intake port 32 (head internal intake passage 35) extends forwardly from the intake upstream side opening 34 of a circular shape and is branched to left and right branch passages 35*a* while being curved downwardly to the left and right intake downstream side openings 33 of a circular shape. A ring-shaped valve seat 33*a* is fitted in each of the left and right intake downstream side openings 33.

The exhaust port 36 has the left and right exhaust upstream side openings 37 open inwardly of the combustion chamber 31, a single exhaust downstream side opening 38 open forwardly on a front face of the cylinder head 17, and a head internal exhaust passage 39 for communicating the left and right exhaust upstream side openings 37 and the exhaust downstream side opening 38 with each other. The exhaust port 36 (head internal exhaust passage 39) extends upwardly from the left and right exhaust upstream side openings 37 of a circular shape and joins left and right branch passages 39*a* while being curved forwardly to the exhaust downstream side opening 38 of a circular shape. A ring-shaped valve seat 37*a* is fitted in each of the left and right exhaust upstream side openings 37.

A pair of left and right intake valves 41 are provided corresponding to the left and right intake downstream side openings 33. Each of the intake valves integrally has a conical valve head 41*a* for closely contacting with an intake downstream side opening 33 (valve seat 33*a*) from the combustion chamber 31 side, and a bar-like stem 41*b* extending from a top portion of the valve head 41*a* to the inside of the valve chamber 19 through the cylinder head 17. At a place of the cylinder head 17 through which the stem 41*b* extends, a valve guide 41*c* for holding the stem 41*b* for stroke movement is provided fixedly. The valve guide 41*c* projects at a lower end portion thereof into the intake port 32. A projection 32*a* is formed on an inner wall of an upper portion of the intake port 32 such that the intake upstream side thereof is swollen smoothly so that intake air can easily ride over a lower end portion of the valve guide 41*c*.

A pair of left and right exhaust valves 42 are provided corresponding to the left and right exhaust upstream side openings 37. Each of the exhaust valves 42 integrally has a conical valve head 42*a* for closely contacting with an exhaust upstream side opening 37 (valve seat 37*a*) from the combustion chamber 31 side, and a bar-like stem 42*b* extending from a top portion of the valve head 42*a* to the inside of the valve chamber 19 through the cylinder head 17. At a place of the cylinder head 17 through which the stem 42*b* extends, a valve guide 42*c* for holding the stem 42*b* for stroke movement is provided fixedly. The stems 41*b* and 42*b* of the intake and exhaust valves 41 and 42 are disposed in a V shape as viewed in the forward and backward direction.

A retainer 41*d* which supports an upper end portion of a valve spring 41*e* is mounted at an end portion of the stem 41*b* of the intake valve 41. A spring pedestal 41*f* which supports a lower end portion of the valve spring 41*e* is formed at a portion of the cylinder head 17 opposing to the retainer 41*d*. The intake valve 41 is biased upwardly by spring force of the valve spring 41*e* provided in a compressed state between the retainer 41*d* and the spring pedestal 41*f* to close up the intake downstream side opening 33. On the other hand, if the intake valve 41 is moved downwardly against the spring force, then the intake valve 41 opens the intake downstream side opening 33.

Similarly, a retainer 42*d* which supports an upper end portion of a valve spring 42*e* is mounted at an end portion of the stem 42*b* of the exhaust valve 42. A spring pedestal 42*f* which supports a lower end portion of the valve spring 42*e* is formed at a portion of the cylinder head 17 opposing to the retainer 42*d*. The exhaust valve 42 is biased upwardly by spring force of the valve spring 42*e* provided in a compressed state between the retainer 42*d* and the spring pedestal 42*f* to close up the exhaust upstream side opening 37. On the other hand, when the exhaust valve 42 is moved downwardly against the spring force, then the exhaust valve 42 opens the exhaust upstream side opening 37.

Left and right output arms 43*d* of an intake rocker arm 43 are engaged from above with a stem end of the left and right intake valves 41, and left and right output arms 44*d* of an exhaust rocker arm 44 are engaged from above with a stem end of the left and right exhaust valves 42. The rocker arms 43 and 44 are supported for rocking motion in the cylinder head 17 through rocker arm shafts 43*a* and 44*a* extending in the forward and backward direction, respectively.

The intake rocker arm 43 integrally has a cylindrical base portion 43*b* in which the rocker arm shaft 43*a* is fitted, a single input arm 43*c* extending rightwardly forwardly from a right front portion of the base portion 43*b*, and left and right output arms 43*d* extending leftwardly rearwardly from the left and right rear portions of the base portion 43*b*.

Similarly, the exhaust rocker arm 44 integrally has a cylindrical base portion 44*b* in which the rocker arm shaft 44*a* is fitted, a single input arm 44*c* extending rightwardly rearwardly from a right rear portion of the base portion 44*b*, and the left and right output arms 44*d* extending leftwardly forwardly from left and right front portions of the base portion 44*b*.

A pair of push rods 45 are engaged at an upper end portion thereof with end portions of the input arms 43*c* and 44*c* of the rocker arms 43 and 44. Tappet bolts 46 which engage with a stem end of the valves 41 and 42 are mounted at end portions of the left and right output arms 43*d* and 44*d* of the rocker arms 43 and 44.

The rocker arms 43 and 44 and the rocker arm shafts 43*a* and 44*a* are disposed at a substantially same height in the cylinder upward and downward direction. The rocker arms 43 and 44 and the rocker arm shafts 43*a* and 44*a* are spaced from each other in the forward and rearward direction such that a first ignition plug 51 hereinafter is removably mounted along the cylinder upward and downward direction. It is to be noted that the rocker arms 43 and 44 are positioned near to each other only at the input arms 43*c* and 44*c* thereof on the right side of the cylinder head 17. Here, reference numeral 47 in the figure denotes a range surrounded by the valves 41 and 42 as viewed in the axial direction of the cylinder head 17 (as viewed in plan) (range formed by interconnecting the centers of the valve heads 41*a* and 42*a* (corresponding to the centers of the intake downstream side openings 33 and the exhaust upstream side openings 37).

Referring also to FIG. 2, a single camshaft 48 having a rotational center axial line (camshaft line) C3 parallel to the crank axial line C1 is disposed on the right side portion of the cylinder head 17. The camshaft 48 has cam lobes corresponding to the push rods 45 for integral rotation. With the cam lobes, the push rods 45 are engaged at a lower end portion thereof through lifters 45*a*. Each of the push rods 45 is inclined such that the upper side thereof in the cylinder upward and downward direction as viewed in the forward and backward direction is positioned on the left side in the cylinder leftward and rightward direction (cylinder axial line C2 side).

The camshaft 48 is driven to rotate in association with the crankshaft 11 through a transmission mechanism of, for example, the chain type. By the rotational driving of the camshaft 48, the push rods 45 are moved upwardly and downwardly in response to outer peripheral patterns of the cam lobes to generate driving force for the valves 41 and 42. The camshaft 48 and the push rods 45 are hereinafter referred to as valve driving mechanism 48A (valve power generation mechanism).

By operation of the valve driving mechanism 48A, the rocker arms 43 and 44 are rocked to move the valves 41 and 42 upwardly and downwardly to open and close the intake downstream side opening 33 of the intake port 32 and the exhaust upstream side opening 37 of the exhaust port 36. It is to be noted that reference symbol 49*a* in the figures denotes a driving mechanism chamber provided on a right side portion of the cylinder head 17 for accommodating the valve driving mechanism 48A while reference symbol 49*b* denotes a transmission mechanism chamber provided forwardly of and contiguously to the driving mechanism chamber 49*a* for accommodating the transmission mechanism described hereinabove.

Here, the engine 10 is formed as a twin-plug engine in order to enhance the combustion performance to achieve enhancement of the output power and reduction in fuel cost, and has the first ignition plug 51 and a second ignition plug 52 at two locations which are different in height from each other in the cylinder upward and downward direction.

In particular, the first ignition plug 51 is disposed coaxially with the cylinder axial line C2 at a central portion of the cylinder head 17, and the second ignition plug 52 is disposed at a left side portion of the cylinder head 17 in an inclined relationship with respect to the cylinder axial line C2 (inclined such that the upper side in the cylinder upward and downward direction is positioned on the left side in the cylinder leftward and rightward direction). Electrode portions of end portions of the ignition plugs 51 and 52 are disposed such that they are directed to the center of the combustion chamber 31. It is to be noted that reference symbols C91 and C92 in the figures denote center axial lines of the ignition plugs 51 and 52, respectively.

Figure 6:
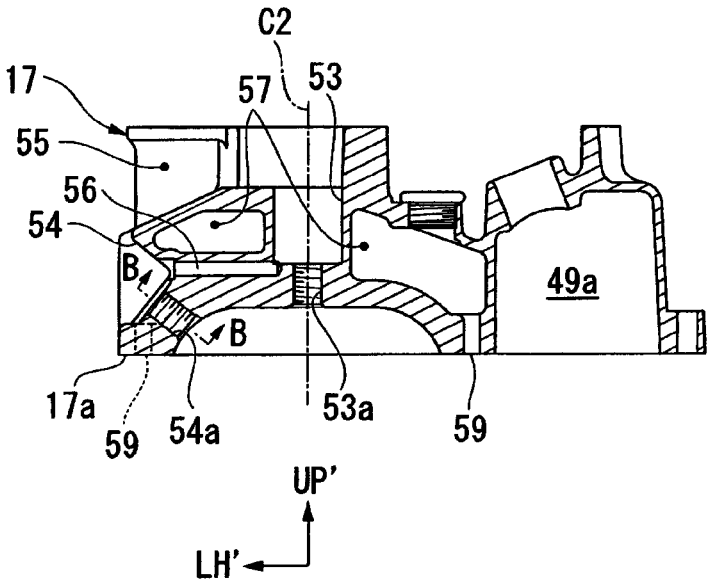
FIG. 6(*a*) is a sectional view taken along line A-A of FIG. 5, and FIG. 6(*b*) is a sectional view taken along line B-B of FIG. 6(*a*).
Figure 6:
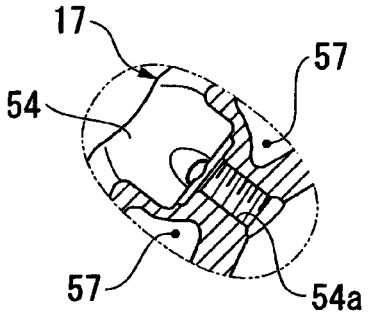

Referring also to FIG. 6(*a*), the cylinder head 17 has formed thereon first and second threaded holes 53*a* and 54*a* into which threaded portions of the first and second ignition plugs 51 and 52 are to be screwed, and counterbored first and second plug holes 53 and 54 for allowing the ignition plugs 51 and 52 to reach the threaded holes 53*a* and 54*a*, respectively. The first ignition plug 51 and the first plug hole 53 are disposed in the range 47 which is a space between the rocker arms 43 and 44 as viewed in the cylinder upward and downward direction and is surrounded by the valves 41 and 42.

The first plug hole 53 is open to the inside of an air jacket 55 formed so as to extend over the cylinder head 17 and the head cover 18. The air jacket 55 allows the first plug hole 53 to be open upwardly in the cylinder upward and downward direction and open in a leftwardly broadening manner in the cylinder leftward and rightward direction. The second plug hole 54 is open upwardly in the cylinder upward and downward direction and leftwardly in the cylinder leftward and rightward direction. A lower end portion of the second plug hole is shallow, and a lower end face of the second plug hole 54 is inclined leftwardly downwardly with respect to a horizontal direction (refer to FIG. 2).

The ignition plugs 51 and 52 are connected to ignition coils (not shown) separate from each other such that they are controlled so that the ignition timings thereof are made different from each other (in order to set a phase difference between the ignition timings). Consequently, while the combustion velocity of fuel air mixture is controlled, good combustion is made possible even where the fuel air mixture is lean thereby to achieve enhancement of the engine output power and the fuel cost. Also enhancement of the emission performance by improvement in combustion by employment of twin plugs is achieved.

A communicating passage or hole 56 extending leftwardly in the cylinder leftward and rightward direction is open at a left end thereof to the left side of a bottom portion of the first plug hole 53. The communicating passage 56 is open at a right end thereof to the right side of a bottom portion of the second plug hole 54 and introduces rainwater and so forth in the first plug hole 53 into the second plug hole 54 making use of the inclination of the cylinder head 17. Since the second plug hole 54 is formed on the left side face of the cylinder head 17 which is inclined downwardly, the rainwater and so forth are easily discharged and the maintenance performance is good.

A cylinder side water jacket 57 is formed on the cylinder main body 16 in such a manner as to surround the outer side of an upper portion of the sleeve 25 (outer side of the combustion chamber 31). Meanwhile, a head side water jacket 58 is formed on the cylinder head 17 such that it extends over the cylinder head 17 while avoiding the ports 32 and 36, plug holes 53 and 54 and so forth.

The cylinder side water jacket 57 is open annularly at a mating face 16*a* of the cylinder main body 16 with the cylinder head 17. Meanwhile, on a mating face 17*a* of the cylinder head 17 with the cylinder main body 16, a plurality of head side openings 59 communicating with the head side water jacket 58 are formed along a circumference opposing to the opening portion of the cylinder side water jacket 57 (refer to FIG. 5). The mating faces 16*a* and 17*a* between the cylinder main body 16 and the cylinder head 17 closely contact with each other with a gasket interposed therebetween such that the water jackets 57 and 58 are communicated with each other to allow distribution of cooling water therebetween.

Referring to FIGS. 5 and 6, the head side openings 59 are formed on the mating face 17*a* of the cylinder head 17 in such a manner as to sandwich the threaded hole 54*a* for the second ignition plug 52 therebetween in a cylinder circumferential direction. By cooling water immediately after flowing into the head side water jacket 58 from the head side openings 59, the threaded hole 54*a* and the second plug hole 54 connecting to the threaded hole 54*a* are cooled favorably and the cooling performance for the second ignition plug 52 is assured. Consequently, the cooling performances for the first ignition plug 51 and the second ignition plug 52 surrounded by the head side water jacket 58 of a comparatively large size become equivalent to each other. As a result, stabilization of ignition timings is achieved and enhancement in productivity and maintenance performance by equalization in heat value between the ignition plugs 51 and 52 is anticipated.

It is to be noted that, as shown in FIG. 3, a water temperature sensor 61 for detecting the temperature of the cooling water immediately after flowing into the head side water jacket 58 from the cylinder side water jacket 57 is attached. Further, as shown in FIGS. 4 and 5, a thermostat case 62 is provided contiguously rearwardly of the driving mechanism chamber 49*a* of the cylinder head 17.

Referring to FIGS. 3 and 7 to 9, the throttle body 21 has a main body 63 in the form of a tube extending forwardly and rearwardly and forming a body internal intake passage 63*a* connecting to the head internal intake passage 35, a butterfly valve 64 supported for pivotal motion in the main body 63 for opening and closing the body internal intake passage 63*a*, and an injector 65 for injecting fuel to the downstream side with respect to the butterfly valve 64. The throttle body 21 is connected at a front end portion thereof to the intake port 32 of the cylinder head 17 through an insulator 21*a* and at a rear end portion thereof to the air cleaner 22 through a connecting tube 21*b*.

The main body 63 has a cylindrical form and has formed therein the body internal intake passage 63*a* of a circular cross section which extends linearly along a center axial line C4 which is inclined forwardly downwardly. The butterfly valve 64 is supported on the main body 63 through a pivot shaft 66 which extends along a diameter of the body internal intake passage 63*a*. The pivot shaft 66 is disposed horizontally and projects at the opposite end portions thereof outwardly of the main body 63. A throttle drum 67 is attached to a right end portion of the pivot shaft 66 such that the butterfly valve 64 can be operated to pivot through a throttle cable 75 by an operating element not shown.

The pivot shaft 66 engages at a left end portion thereof with a throttle opening sensor (not shown) in a sensor case 68 attached to the left side of the main body 63. It is to be noted that also an intake air temperature sensor and an intake air pressure sensor are included in the sensor case 68. The butterfly valve has a form of a circular flat plate and is pivoted only in one direction around the pivot shaft 66 to form openings of an equal area above and below the pivot shaft 66.

Referring to FIG. 3, the injector 65 is disposed at an upper end portion (top portion) of the main body 63 in the vertical direction in a posture in which a center axial line C5 thereof is inclined forwardly downwardly. At a front end 65*a* of the injector 65 which faces the body internal intake passage 63*a*, a pair of fuel injection ports (not shown) are provided which carry out fuel injection into two directions which are branched in a broadening manner equally between the left and right with respect to the center axial line C5.

Figure 10B:
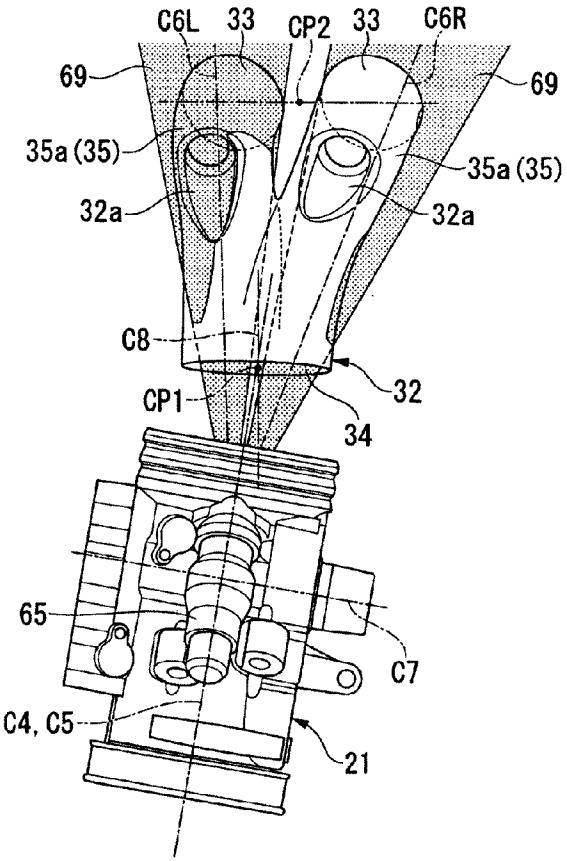
FIG. 10(*a*) is a view showing arrangement of an intake port and a throttle body in a comparative example as viewed from above, and FIG. 10(*b*) is a view showing such arrangement in the present embodiment as viewed from above.
Figure 10A:
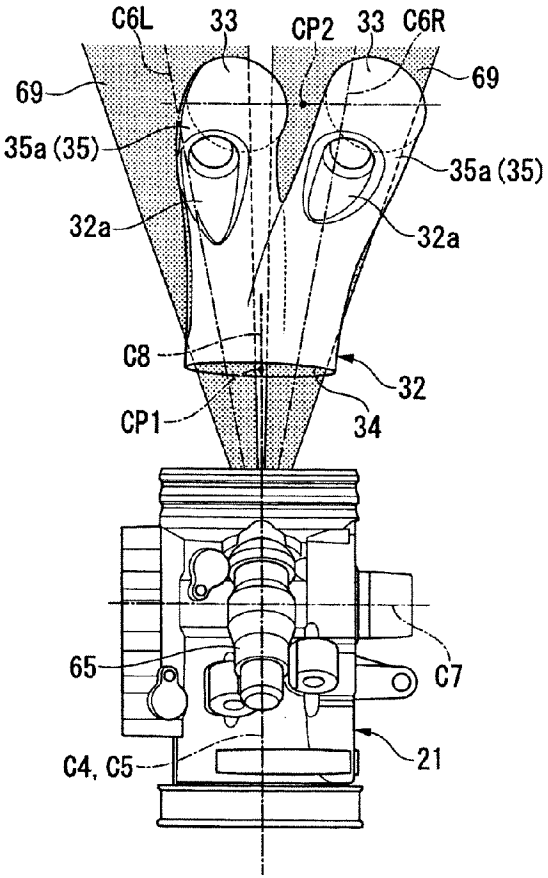
Figure 11:
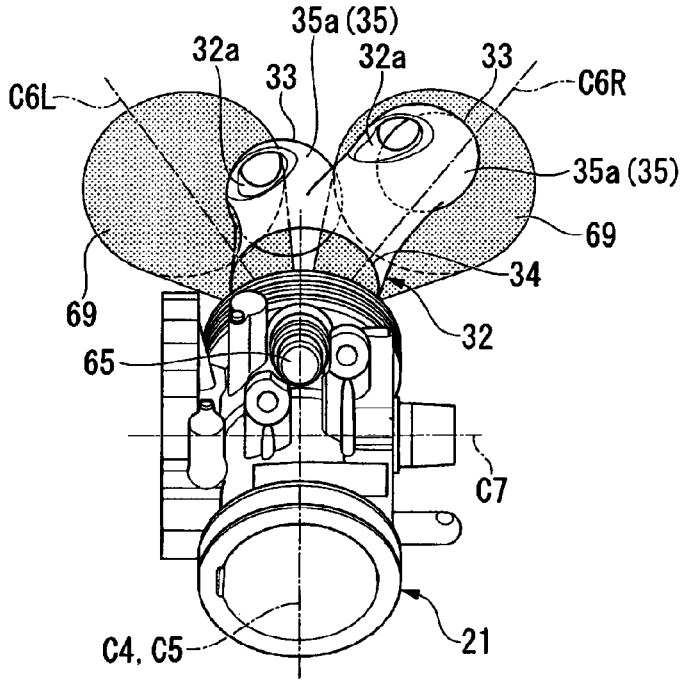
FIG. 11(*a*) is a view showing arrangement of the intake port and the throttle body in the comparative example as viewed from upwardly rearwardly, and FIG. 11(*b*) is a view showing such arrangement in the present embodiment as viewed from upwardly rearwardly.
Figure 11:
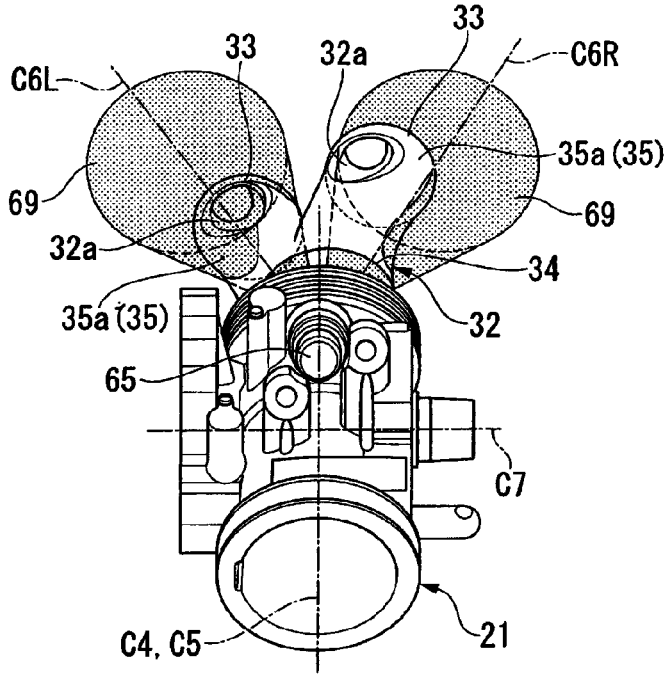

Referring also to FIGS. 10 and 11, the fuel injection in the two directions forms fuel sprays (spray foams) 69 of a conical shape. Center axial lines C6L and C6R of the fuel sprays 69 are disposed on a plane parallel to a center axial line C7 of the pivot shaft 66 disposed horizontally. In other words, the fuel sprays are formed so as to be disposed in a juxtaposed relationship on the left and right along the horizontal pivot shaft 66.

Meanwhile, the left and right intake downstream side openings 33 are juxtaposed in the cylinder leftward and rightward direction inclined with respect to the horizontal leftward and rightward direction. In the present embodiment, in order to carry out optimum fuel injection toward the left and right intake downstream side openings 33, the leftward and rightward fuel sprays 69 are deflected to one side in the cylinder leftward and rightward direction together with the throttle body 21 as hereinafter described to achieve enhancement in emission performance, engine output power and fuel cost while maintaining the versatility of the throttle body 21.

The injector 65 is disposed such that the center axial line C5 forms an acute angle with respect to the center axial line C4 of the main body 63 (the injector 65 is laid down) in order to allow the fuel sprays 69 to reach the downstream side of the intake port 32 to the utmost. A fuel spray relief portion 71 for avoiding the fuel sprays 69 is provided in a concave manner at an upper end portion of the inner periphery of a front portion of the main body 63. The fuel spray relief portion 71 extends to a front end of the main body 63, and a second fuel spray relief portion 72 is provided in a concave manner at an upper end portion of the inner periphery of a rear portion of the insulator 21*a* in such a manner as to connect to the front of the fuel spray relief portion 71.

Figure 7:
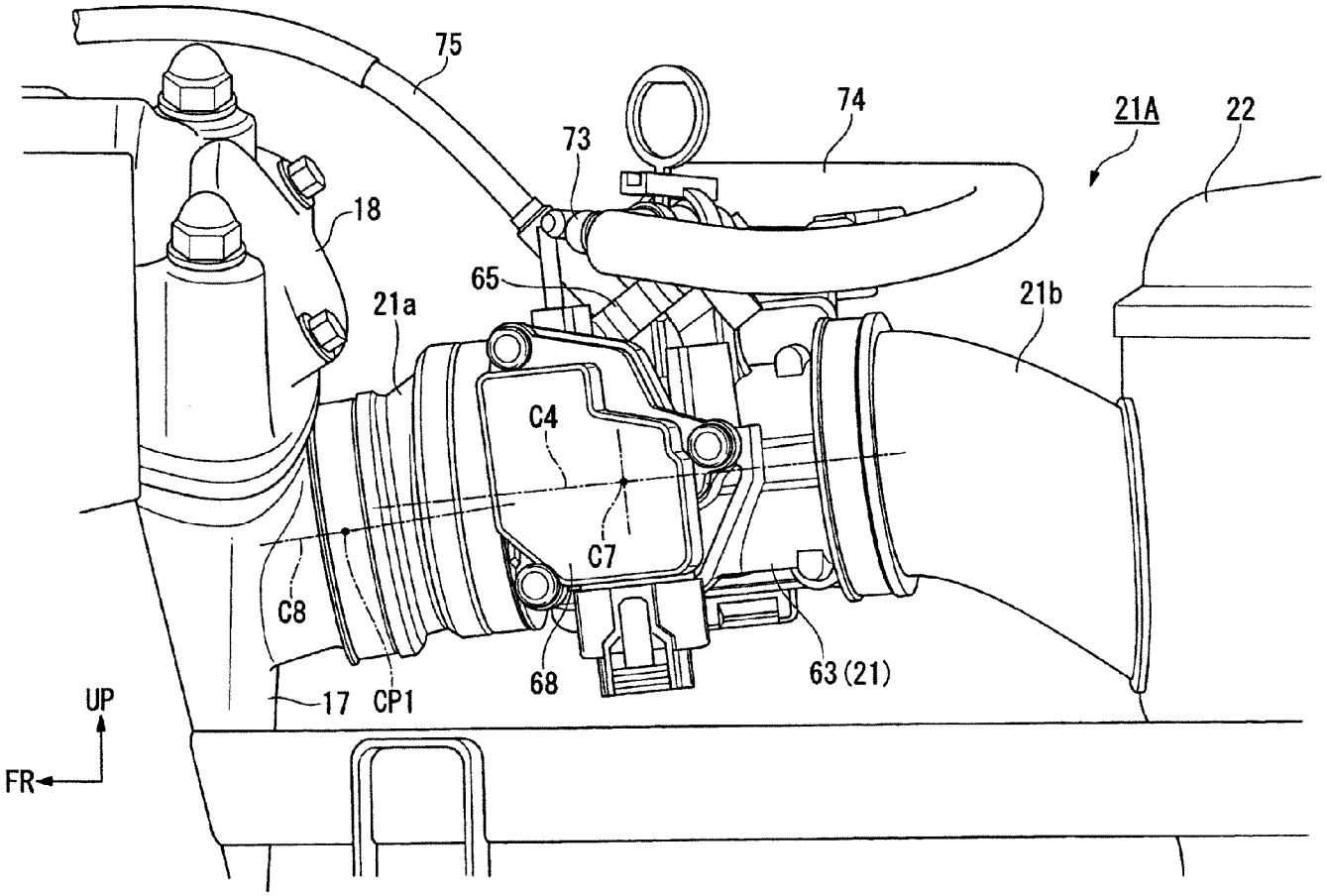
FIG. 7 is a left side elevational view showing a periphery of a throttle body of the engine.
Figure 8:
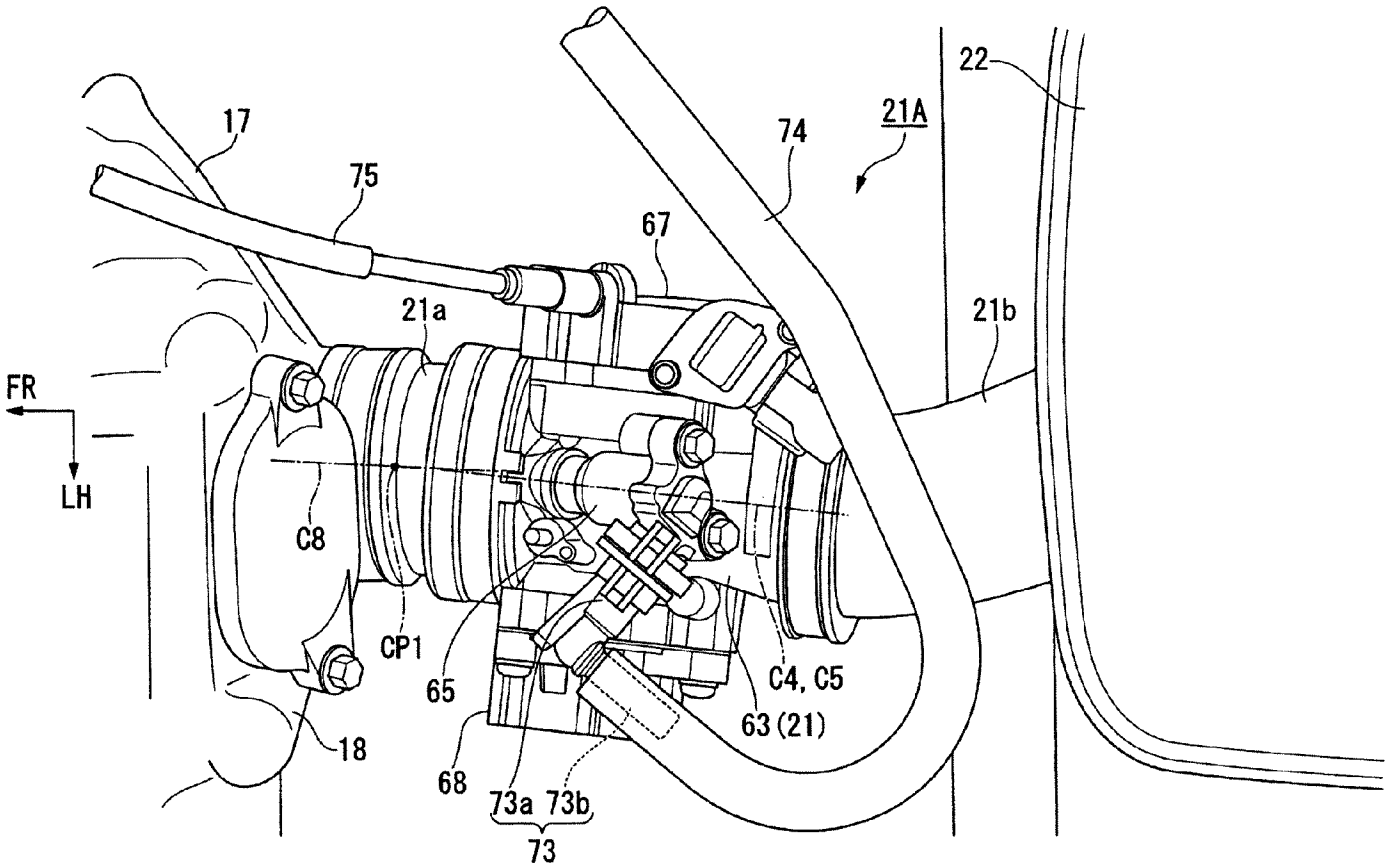
FIG. 8 is a top plan view showing the periphery of the throttle body of the engine.
Figure 9:
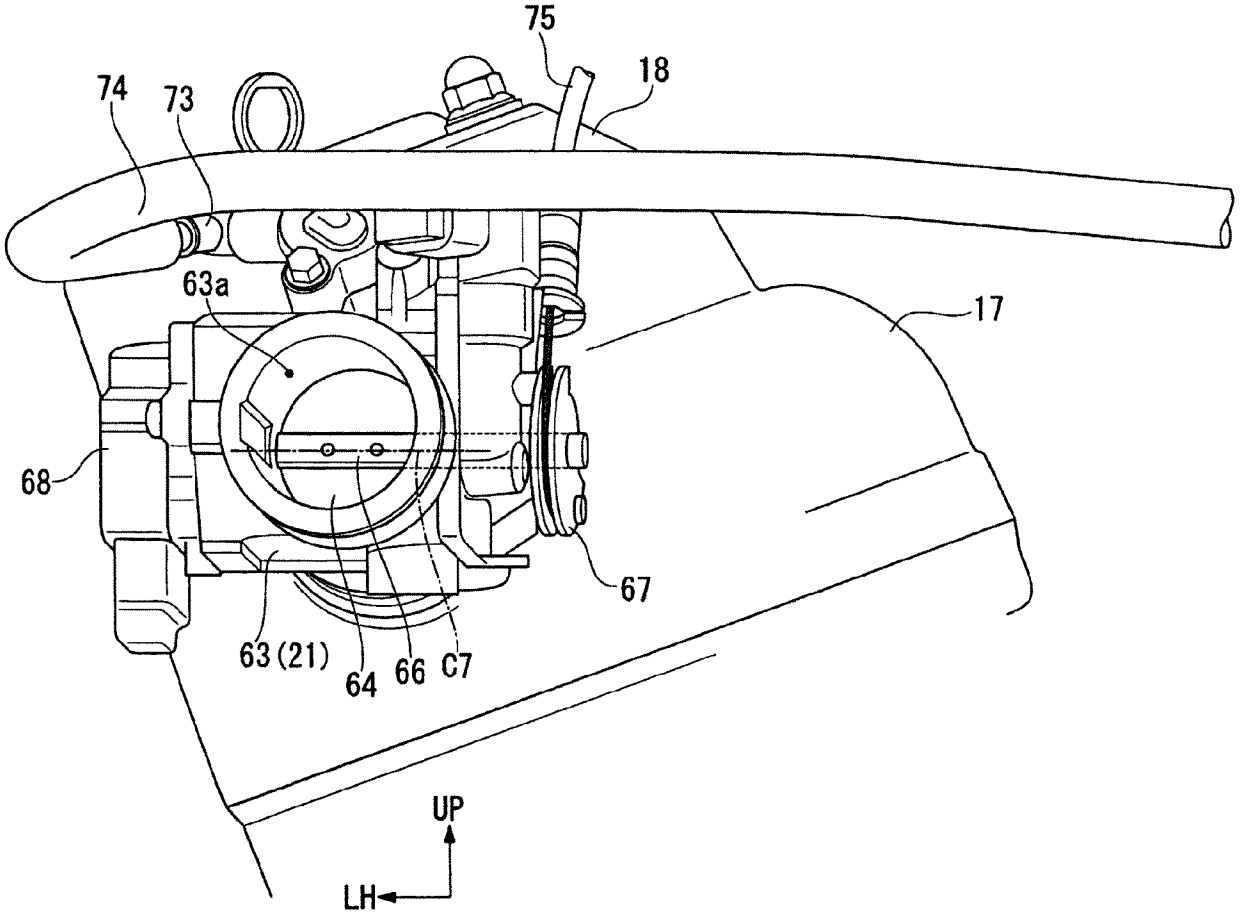
FIG. 9 is a rear elevational view showing the periphery of the throttle body of the engine.

Referring to FIGS. 7 to 9, a fuel hose 74 is connected to a rear end portion of the injector 65, which projects outwardly of the main body 63, through an L-shaped hose joint 73. The hose joint 73 integrally has a first edge portion 73*a* extending leftwardly forwardly from a rear end portion of the injector 65 and a second edge portion 73*b* extending leftwardly rearwardly from a left end portion of the first edge portion 73*a*. The second edge portion 73*b* is inserted in and held by an end portion of the fuel hose 74. The fuel hose 74 extends from a fuel pump not shown, extends substantially horizontally toward the left rear from an upper and right portion of the throttle body 21, is folded back to the right front leftwardly and rearwardly of the throttle body 21 and is fitted outwardly with the second edge portion 73*b*.

Referring to FIG. 5, the intake port 32 is formed such that a center position CP1 of the intake upstream side opening 34 is offset by a predetermined amount F to one side in the juxtaposition direction of the intake downstream side openings 33 (to the left side in the cylinder leftward and rightward direction) with respect to a center position CP2 between the intake downstream side openings 33 in the juxtaposition direction (in the cylinder leftward and rightward direction) as viewed in the cylinder axial direction. Consequently, the left branch passage 35*a* extending to the left intake downstream side opening 33 is shorter and bent by a smaller amount than the right branch passage 35*a* which extends to the right intake downstream side opening 33.

Referring also to FIGS. 7 to 9, the intake upstream side opening 34 of the intake port 32 is provided such that a center axial line C8 thereof is inclined rearwardly upwardly as viewed in the cylinder leftward and rightward direction. Since the cylinder head 17 is inclined leftwardly, the center axial line C8 of the intake upstream side opening 34 is inclined rearwardly upwardly as viewed in side elevation and is slightly inclined also in plan view such that the rear side is positioned on the left side.

The throttle body 21 is inclined, as viewed in side elevation, rearwardly upwardly such that the center axial line C4 of the main body 63 has an angle a little smaller than the center axial line C8 of the intake upstream side opening 34. Further, the throttle body 21 is inclined, as viewed in plan, such that the center axial line C4 of the main body 63 forms an angle a little greater than the center axial line C8 of the intake upstream side opening 34 such that the rear side is positioned on the left side.

The angle variation of the center axial line C4 with respect to the center axial line C8 as viewed in side elevation is provided around the proximity of the pivot shaft 66. Therefore, the front end opening of the throttle body 21 is displaced upwardly with respect to the intake upstream side opening 34 of the intake port 32.

Meanwhile, the angle variation of the center axial line C4 with respect to the center axial line C8 as viewed in plan is provided around the proximity of the center position CP1 of the intake upstream side opening 34.

The front end 65*a* of the injector 65 is displaced a little leftwardly (to the offset side of the intake upstream side opening 34) with respect to the center axial line C8 of the intake upstream side opening such that fuel is injected from the position toward the counter offset side (rightwardly) of the intake upstream side opening 34.

The intake port 32 of FIGS. 10 and 11 shows an inner face shape, and dots similar to those of the fuel sprays 69 are marked in regions of the inner face shape which the fuel sprays 69 hit.

Referring to FIG. 10(*a*) and FIG. 11(*a*), if fuel is injected from the injector 65 in such arrangement that, in the intake port 32, the center axial line C8 of the intake upstream side opening 34 and the center axial line C5 of the injector 65 (which is a fuel injection center axis line and is a bisector of the angle between center axial lines C9L and C9R of the left and right fuel sprays 69) are registered as viewed in the cylinder axis direction, then the fuel sprays 69 are liable to flow in a one-sided state into the left branch passage 35*a* which exhibits comparatively low resistance and besides the two injection regions (spray foams) are less likely to hit an upper portion of the port inner wall (the fuel sprays 69 are likely to hit a lower portion of the port inner wall one-sidedly such that the fuel is likely to adhere to the same).

In contrast, with the engine 10 of the present embodiment, as viewed in the direction of the cylinder axis, the center axial line C5 of the injector 65 is inclined so as to be directed to the right side in the cylinder leftward and rightward direction with respect to the center axial line C8 of the intake upstream side opening 34 (to the counter offset side of the intake upstream side opening 34) (so as to be inclined to the right side in the cylinder leftward and rightward direction).

Consequently, as seen in FIG. 10(*b*) and FIG. 11(*b*), one-sided inflow of the fuel sprays 69 is suppressed and besides the two injection regions become likely to hit also an upper portion of the port inner wall (fuel becomes less likely to adhere to a lower portion of the port inner wall).

In a port injection gasoline engine, if fuel adheres to a port inner wall, then part of the fuel sometimes flows directly into a cylinder while remaining in the phase of liquid without being vaporized (atomized), resulting in increase of HC (Hydro Carbon) in the exhaust gas when the engine is cold or is in transition running or degradation of the fuel cost and the drivability.

However, by suppressing adhesion of fuel to the port inner wall, HC in the exhaust gas decreases and the emission performance is improved, and feedback control of fuel injection is carried out with a higher degree of accuracy, resulting in enhancement of the fuel cost and the drivability.

Further, since the second ignition plug 52 is positioned on the offset side of the intake upstream side opening 34, the arriving speed of fuel air mixture at the electrode portions of the second ignition plug 52 is increased thereby to suppress fuel adhesion to the electrode portions. At this time, an air flow (swirl and so forth) in the combustion chamber 31 is promoted, and also the combustibility is enhanced.

As described above, the engine 10 in the embodiment described above is an internal combustion engine including two intake valves 41 provided per one cylinder, an intake port 32 formed in a cylinder head 17 and branched to two for communicating two intake downstream side openings 33 which are individually opened and closed by the intake valves 41. A single intake upstream side opening 34 is provided, to which an intake system part 21A is connected. An injector 65 can be attached to the intake system part 21A (throttle body 21) for injecting fuel into the intake port 32. The intake downstream side openings 33 are juxtaposed at an equal height in the axial direction of the cylinder head 17. The intake port 32 is configured such that a center position CP1 of the intake upstream side opening 34 is offset to one side in the juxtaposition direction of the intake downstream side openings 33 with respect to a center position CP2 between the intake downstream side openings 33 in the juxtaposition direction as viewed in the axial direction of the cylinder head 17. The injector 65 disposed at an upper portion of the intake system part 21A is configured such that a fuel injection center axial line C5 thereof is inclined to the other side in the juxtaposition direction with respect to a center axial line C8 of the intake upstream side opening 34 as viewed in the axial direction of the cylinder head 17.

With this configuration, fuel can be injected from the injector 65, which is offset to the one side in the juxtaposition direction of the intake downstream side openings 33 together with the intake upstream side opening 34, toward the two branch passages 35*a* of the intake port 32 while minimizing one-sidedness. Consequently, adhesion fuel to the port inner wall can be reduced thereby to achieve purification of exhaust gas components and enhancement of an engine performance.

Further, in the engine 10 described above, the center axial line C2 of the cylinder head 17 is inclined with respect to a vertical direction such that the other side thereof in the juxtaposition direction is positioned higher, and the injector 65 is disposed at a top portion of the intake system part 21A (throttle body 21) in the vertical direction. Therefore, the mounting angle of the injector 65 on the intake passage is easy to stand in a direction perpendicular to the intake passage, and the relief shape of fuel injection to be formed on the intake system part 21A can be reduced in size. Further, adhesion fuel to the port inner wall can be further reduced while making a port particle characteristic smooth, and purification of exhaust gas components and enhancement in engine performance can be anticipated.

Further, in the engine 10 described above, the intake system part 21A has a throttle body 21 disposed on the upstream side of the intake port 32 and an insulator 21*a* for interconnecting the throttle body 21 and the intake port 32. At a top portion of the throttle body 21 in the vertical direction, the injector 65 is disposed and a fuel spray relief portion 71 is formed by cutting away an inner wall thereof. At a top portion of the insulator 21*a* in the vertical direction, a second fuel spray relief portion 72 connecting to the fuel spray relief portion 71 of the throttle body 21 is formed by cutting away an inner wall thereof. Therefore, the mounting position of the injector 65 can be positioned near to the intake port 32 to the utmost, and fuel can be injected efficiently to the downstream side of the intake port 32. Further, adhesion fuel to the port inner wall can be further reduced to achieve purification of exhaust gas components and enhancement in engine performance.

Further, in the engine 10 described above, the throttle body 21 has a tubular main body 63 which forms a body internal intake passage 63*a*, a pivot shaft 66 which crosses the body internal intake passage 63*a* horizontally, and a butterfly valve 64 supported on the main body 63 through the pivot shaft 66 for opening and closing the body internal intake passage 63*a*. The injector 65 carries out fuel injection which is branched to two directions along a plane parallel to a center axial line C7 of the pivot shaft 66. Therefore, even where the intake port 32 is inclined on the left or right, intake air and fuel spray 69 in a transition state upon an increase of the opening of the butterfly valve 64 from a low opening state cross with each other in the same phase in a circumferential direction. Consequently, one-sidedness in production of fuel air mixture can be reduced, and adhesion fuel to the port inner wall can be reduced to achieve purification of exhaust gas components and enhancement in engine performance.

Further, the engine 10 described above further includes a throttle drum 67 secured to one end of the pivot shaft 66, a sensor case 68 for engaging with the other end of the pivot shaft 66, an L-shaped hose joint connected to the injector 65, and a fuel hose 74 extending above the sensor case 68 and connected to the hose joint 73. Consequently, cord-like members such as a throttle cable 75 and a fuel hose 74 connected to the throttle drum 67 and wiring lines connected to the sensor case 68 can be arranged optimally around the throttle body 21.

It is to be noted that the present invention is not limited to the embodiment described above but may be applied to an engine, for example, not only for the four-wheeled vehicle described hereinabove but also for such a vehicle as a two-wheeled vehicle or a three-wheeled vehicle. Further, the present invention may be applied to a plural-cylinder engine such as a parallel or V type plural-cylinder engine or a horizontal engine having a crank axial line extending along the vehicle leftward and rightward direction.

Further, the configuration of the embodiment described above is an example of the present invention and can be modified in various manners without departing from the subject matter of the invention.

DESCRIPTION OF REFERENCE SYMBOLS

10 Engine (internal combustion engine)
16 Cylinder main body
17 Cylinder head
17*a* Mating face
C2 Center axial line
21A Intake system part
21 Throttle body
21*a* Insulator
32 Intake port
33 Intake downstream side opening
CP2 Center position
34 Intake upstream side opening
CP1 Center position
C8 Center axial line
41 Intake valve
63 Main body
63*a* Body internal intake passage (intake passage)
64 Butterfly valve (throttle valve)
65 Injector (fuel injection valve)
66 Pivot shaft
C7 Center axial line
67 Throttle drum
68 Sensor case (sensor)
C5 Fuel injection center axial line
71 Fuel spray relief portion
72 Second fuel spray relief portion
73 Hose joint
74 Fuel hose

The invention claimed is:

1. An internal combustion engine including two intake valves provided per one cylinder, an intake port formed in a cylinder head and branched to two for communicating with two intake downstream side openings which are individually opened and closed by said intake valves and a single intake upstream side opening to which an intake system part is connected, a fuel injection valve attached to said intake system part for injecting fuel into said intake port, and a first spray relief portion and a second spray relief portion located near the fuel injection valve, wherein said intake downstream side openings are juxtaposed at an equal height from a mating face of said cylinder head with a cylinder main body;

wherein said intake port is configured such that a center position of said intake upstream side opening is offset to one side in a juxtaposition direction of said intake downstream side openings with respect to a center position between said intake downstream side openings in the juxtaposition direction as viewed in plan of said cylinder head, wherein said fuel injection valve disposed at an upper portion of said intake system part is configured such that a fuel injection center axial line thereof is positioned on a central line of the intake system part and the intake upstream side opening, while also being inclined to another side in the juxtaposition direction with respect to a center axial line of said intake downstream side opening as viewed in plan of said cylinder head, wherein a central axis line of the cylinder head passing a cylinder center is inclined with respect to a crankcase such that a first side of the cylinder head is positioned higher than a second side of the cylinder head, wherein the fuel injector valve includes a pair of fuel injection ports, wherein the fuel injection ports carry out fuel injection into two directions which are branched in a broadening manner equally between the one side and the another side of the center axial line, and wherein the first fuel spray relief portion extends to a front end of a main throttle body, and the second fuel spray relief portion is provided in a concave manner at an upper end portion of an inner periphery of a rear portion of an insulator connected to the throttle body in such a manner as to connect to a front end of the first fuel spray relief portion.

2. The internal combustion engine according to claim 1, wherein said fuel injection valve is disposed at a top portion of said intake system part in the vertical direction.

3. The internal combustion engine according to claim 1, wherein said intake system part comprises the throttle body disposed on the upstream side of said intake port and the insulator for interconnecting said throttle body and said intake port, and, wherein at a top portion of said throttle body in the vertical direction, said fuel injection valve is disposed and the first fuel spray relief portion is formed by cutting away an inner wall thereof while, at a top portion of said insulator in the vertical direction, a second fuel spray relief portion connecting to said fuel spray relief portion of said throttle body is formed by cutting away an inner wall thereof.

4. The internal combustion engine according to claim 3, wherein said throttle body comprises a tubular main body which forms an intake passage, a pivot shaft which crosses said intake passage horizontally, and a throttle valve supported on said main body through said pivot shaft for opening and closing said intake passage, and wherein said fuel injection valve is configured to perform fuel injection which is branched to two directions along a plane parallel to a center axial line of said pivot shaft.

5. The internal combustion engine according to claim 4, further comprising a throttle drum secured to one end of said pivot shaft, a sensor for engaging with another end of said pivot shaft, an L-shaped hose joint connected to said fuel injection valve, and a fuel hose extending above said sensor and connected to said hose joint.

6. An internal combustion engine, comprising:

a cylinder main body having at least one cylinder therein;

a cylinder head;

a plurality of intake valves, disposed such that two intake valves are provided per one cylinder, wherein an intake port is disposed in the cylinder head, and branched so as to communicate with two intake downstream side openings which are individually opened and closed by said intake valves, and a single upstream side opening to which an intake system part is connected, said engine further comprising a fuel injection valve attached to said intake system part, said fuel injection valve configured to inject fuel into said intake port, and a first spray relief portion and a second spray relief portion located near the fuel injection valve, wherein said intake downstream side openings are juxtaposed at an equal height from a mating phase of said cylinder head with said cylinder main body, said intake port being configured such that a center position of said intake upstream side opening is offset to one side in a juxtaposition direction of said intake downstream side opening with respect to a center position between said intake downstream side opening in the juxtaposition direction as viewed in plan of said cylinder head, and said fuel injection valve is disposed at an upper portion of said intake system part, wherein said fuel injection valve being configured such that a fuel injection center axial line thereof is positioned on a central line of the intake system part and the intake upstream side opening while also being inclined to another side in the juxtaposition direction with respect to a center axial line of said intake downstream side opening as viewed in plan of said cylinder head, wherein a central axis line of the cylinder head passing a cylinder center is inclined with respect to a crankcase such that a first side of the cylinder head is positioned higher than a second side of the cylinder head, wherein the fuel injector valve includes a pair of fuel injection ports, wherein the fuel injection ports carry out fuel injection into two directions which are branched in a broadening manner equally between the one side and the another side of the center axial line, and wherein the first fuel spray relief portion extends to a front end of a main throttle body, and the second fuel spray relief portion is provided in a concave manner at an upper end portion of an inner periphery of a rear portion of an insulator connected to the throttle body in such a manner as to connect to a front end of the first fuel spray relief portion.

7. The internal combustion engine according to claim 6, wherein said fuel injection valve is disposed at a top portion of said intake system part in the vertical direction.

8. The internal combustion engine according to claim 6, wherein the intake system part comprises the throttle body disposed on the upstream side of said intake port, and the insulator for interconnecting said throttle body and said intake port, and wherein at a top portion of said throttle body in the vertical direction, said fuel injection valve is disposed, and wherein the first fuel spray relief portion is disposed in an inner wall thereof, and the second fuel spray relief portion, connecting to the first fuel spray relief portion, is disposed in an inner wall of said insulator.

9. The internal combustion engine according to claim 8, wherein said throttle body comprises a tubular main body which forms an intake passage, a pivot shaft crossing said intake passage, and a throttle valve supported on said main body through said pivot shaft for opening and closing said intake passage, and wherein said fuel injection valve is configured to perform fuel injection branched in two directions along a plane parallel to a center axial line of said pivot shaft.

10. The internal combustion engine according to claim 9, further comprising a throttle drum secured to one end of said pivot shaft, a sensor for engaging with another end of said pivot shaft, an L-shaped hose joint connected to said fuel injection valve, and a fuel hose extending above said sensor and connected to said hose joint.

* * * * *